United States Patent [19]

Bernard et al.

[11] 4,299,216

[45] Nov. 10, 1981

[54] SELF-CONTAINED CLOSED CIRCUIT BREATHING APPARATUS HAVING A BALANCED BREATHING RESISTANCE SYSTEM

[75] Inventors: Thomas E. Bernard; Richard L. Stein, both of Pittsburgh, Pa.

[73] Assignee: The United States of America as represented by the Secretary of the Interior, Washington, D.C.

[21] Appl. No.: 85,569

[22] Filed: Oct. 17, 1979

[51] Int. Cl.[3] ..... A62B 7/10

[52] U.S. Cl. ..... 128/205.12; 128/205.17; 128/205.28

[58] Field of Search ..... 128/202.26, 203.28, 128/204.18, 204.19, 204.22, 204.26, 204.28, 205.11, 205.12, 205.13, 205.17, 205.16, 205.18, 205.24, 205.28, 720, 725, 727, 728; 272/99

[56] References Cited

U.S. PATENT DOCUMENTS 3,837,337 9/1974 LaViolette ..... 128/205.12

*Primary Examiner*—Henry J. Recla

*Attorney, Agent, or Firm*—Thomas Zack; Donald A. Gardiner

[57] ABSTRACT

A self-contained, closed circuit breathing apparatus having a balanced breathing resistance system is provided by an apparatus comprising an inhalation conduit and an exhalation conduit, a mouth connection communicating with said conduits for making connection with the mouth of the operator, an inhalation check valve and an exhalation check valve on either side of said mouth connection providing uni-directional flow through said inhalation and exhalation conduits, respectively, a chemical canister connected across said inhalation and exhalation conduits, a pre-canister storage container communicating with said exhalation conduit, said pre-canister storage container being provided with a uni-directional impedance component comprised of a resistance means for allowing one part of the exhaled air during exhalation to pass into the pre-canister storage container and the remainder to pass through said chemical canister into a post-canister storage container and a uni-directional check valve permitting essentially free flow of air out of said pre-canister storage container during inhalation and said post-canister storage container being provided with a uni-directional impedance component comprised of a uni-directional check valve permitting essentially free flow of air into said post-canister storage container during exhalation and with a resistance means permitting restricted flow of air from said post-canister storage container during inhalation.

6 Claims, 1 Drawing Figure

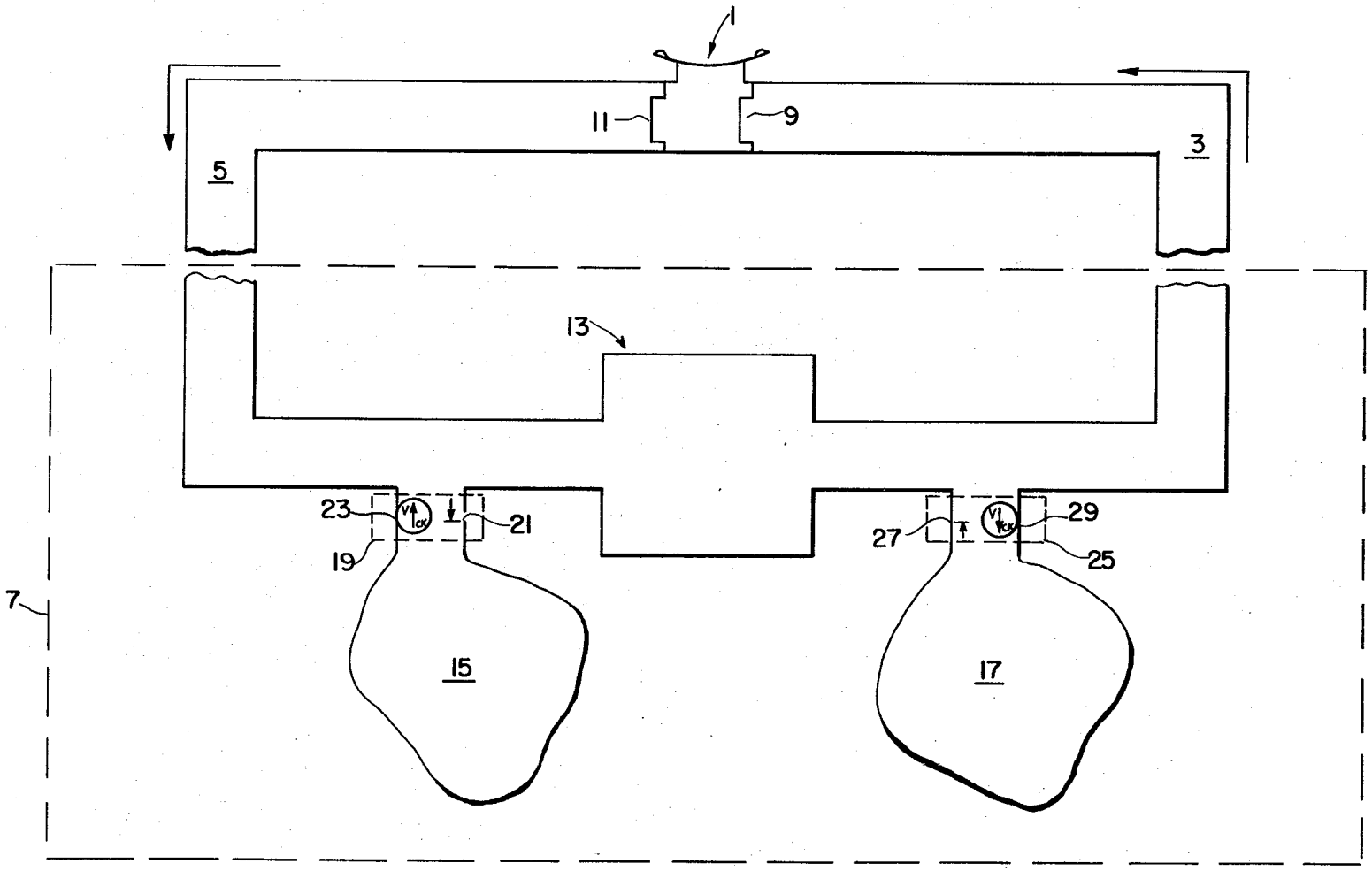
1
3
5
7
9
11
13
15
17
19
21
23
25
27
29

SELF-CONTAINED CLOSED CIRCUIT BREATHING APPARATUS HAVING A BALANCED BREATHING RESISTANCE SYSTEM

BACKGROUND OF THE INVENTION

1. Field of the Invention

This invention relates to a self-contained closed circuit breathing apparatus. More particularly, this invention relates to a self-contained closed circuit breathing apparatus which is able to control the distribution of respiratory work between exhalation and inhalation. Balancing this breathing work load in such closed circuit breathing apparatus proves a significant physiological advantage since it is well known that balanced resistance, i.e. balanced exhalation and inhalation pressure is tolerated much better by wearers of breathing apparatus than are breathing apparatus systems which have unbalanced resistance.

2. Description of the Prior Art

All commercially available closed circuit breathing apparatus approved under 30 CFR 11 and being used today do not have balanced inhalation and exhalation resistance. This is because all exhalation flow passes through a carbon dioxide-removing chemical canister at high resistance before entering the breathing bag. Upon inhalation, the gas passes out of the breathing bag into the mouthpiece at low resistances. Thus, in these apparatus exhalation resistance is much higher than inhalation resistance.

Resistance is directly related to flow rate through the apparatus [$R=K$ (flow rate)$^n$] where R is resistance, K is a constant, and n is a number between 1 and 2 depending on whether the flow rate is laminar or turbulent. Since resistance is directly related to the flow rate, a lower flow rate means a lower resistance. In a closed circuit breathing apparatus, the $CO_2$-removing canister has the highest resistance to the flow rate. Therefore, if the flow rate through the canister can be reduced during exhalation, then resistance to exhalation flow rate will be reduced.

U.S. Pat. No. 3,837,337 to Paul A. LaViolette describes a self-contained closed circuit breathing apparatus which embodies a dual air bag system. In accordance with the invention of U.S. Pat. No. 3,837,337, a positive pressure bag is positioned upstream of the carbon-dioxide removing canister and a negative pressure bag is positioned downstream of the canister. During the exhalation portion of the cycle, a positive pressure is built up in the positive pressure bag, whereas during the inhalation half of the cycle a negative pressure is created in the negative pressure bag. As the pressure in the two bags tends to equalize itself by flowing through the canister, flow can take place throughout the complete breathing cycle. This means that the dual bag system of the patent evenly distributes the respiratory work between inhalation and exhalation. One shortcoming of the dual bag system of the patent, however, is that it cannot be adjusted to other distribution patterns.

Moreover, it is necessary that the dual bags in the invention of U.S. Pat. No. 3,837,337 must either have a resilient means such as in elastic material construction or be subjected to spring forces. This can lead to increased weight and complexity as well as the potential problem of toxic gas permeation. In addition, if the bags are not resilient, the breathing resistance will be erratic with high peak pressures.

It is an object of the invention, therefore, to provide a self-contained closed circuit breathing apparatus which is capable of dividing the respiratory work between inhalation and exhalation in predetermined proportions.

Another object of the invention is to provide a self-contained closed circuit breathing apparatus which can provide a controlled range of proportionate respiratory loads between inhalation and exhalation without the necessity of resilient means such as elastic bags and spring forces.

Yet another object of the invention is to provide two small and variable sized breathing bags to increase variability in the design of closed circuit breathing apparatus.

SUMMARY OF THE INVENTION

These other objects of the invention are obtained by a self-contained closed circuit breathing apparatus comprising an inhalation conduit and an exhalation conduit, a mouth connection communicating with said conduits for making connections with the mouth of the operator, an inhalation check valve and exhalation check valve on either side of said mouth connection providing unidirectional flow through said inhalation and exhalation conduits, respectively, a chemical canister connected across said inhalation and exhalation conduits, a pre-canister storage container communicating with said exhalation conduit and a post-canister storage container communicating with said inhalation conduit, said pre-canister storage container being provided with a unidirectional impedance component comprised of a resistance means for allowing one part of the exhaled air during exhalation to pass into a pre-canister container and the remainder to pass through said chemical canister into said post-canister storage container and unidirectional check valve permitting essentially free flow of air out of said pre-canister storage container during inhalation and said post-canister storage container being provided with a unidirectional impedance component comprised of a uni-directional check valve permitting essentially free flow of air into said post-canister storage container during exhalation and with a resistance means permitting restricted flow of air from said post-canister storage container during inhalation.

Thus, the breathing apparatus of the present invention reduces flow through the chemical canister during exhalation of allowing only a controlled portion of the exhaled breath to pass through the carbon dioxide removing canister and deposit into a pre-canister storage container rather than the whole breath as is done now in current closed circuit breathing apparatus. The portion of the breath which does not pass through the canister passes through an artifical resistance means into a pre-canister storage container. The proportion is generally dependent upon the relationship of the resistance of the canister and the pre-canister storage container. Upon inhalation, the gas in the pre-canister storage container moves freely to the carbon dioxide-removing canister and then must pass through the canister resistance before entering the wearer's mouth. In addition, the gas from the post-canister storage container must also pass through a artifical resistance. Therefore, the inhalation resistance will rise over the systems which store all the gas in the breathing bag and allow it to flow out with little impedence.

The work of inhalation is:

$W_{in}$=[inhalation pressure (resistance) at mean flow rate]$_x$ (minute volume)

The work of exhalation is:

$W_{ex}$=[exhalation pressure (resistance) at mean flow rate]$_x$ (minute volume)

Accordingly, when the exhalation resistance due to the balanced resistance breathing system is reduced, the exhalation work is also reduced. On the other hand, the balanced breathing resistance system increases the inhalation resistance, and thus the work of inhalation is increased. The total respiratory work remains about the same but is redistributed.

BRIEF DESCRIPTION OF THE DRAWING

The drawing is a diagramical representation in section of a preferred embodiment of the invention.

DESCRIPTION OF PREFERRED EMBODIMENT

In the drawing, the apparatus comprises a mouth piece 1 which communicates with inhalation conduit 3 and an exhalation conduit 5 which lead to apparatus contained in an enclosure 7. A check valve 9 is provided in the inhalation conduit 3 and a check valve 11 is provided in exhalation conduit 5. The check valves 9 and 11 and the mouthpiece 1 often comprise a single piece of equipment i.e. an integral component. The inhalation conduit 3 and exhalation conduit 5 are flexible conduits, preferably of rubber material. A face mask sometimes is used in place of the mouthpiece 1, both being referred advantageously have a total volume of at least the greatest expected tidal volume of about 5 liters. The actual volume of each container is a design parameter and may vary depending upon the particular use to which the apparatus is going to be put.

The basic operation of the balanced breathing resistance system of the invention is as follows:

Expired gas from the user enters mouthpiece 1 and is directed to the exhalation conduit 5 by virtue of the check valve 11. The exhaled air flow is then divided with a fraction going into pre-canister storage container 15 and the remaining fraction going through chemical canister 13 and into post-canister storage container 17 with negligible resistance at the unidirectional check valve 29. The fraction of gas entering storage container 15 is determined by $f_e$. Because the gas flow is through parallel impedences, the work of exhalation is decreased from that it would be if the entire flow was through the canister 13 as in the case of conventional closed circuit systems.

Upon inhalation, air flows to the user through the inhalation conduit 3 and mouthpiece 1 by virtue of check valve 9. The gas comes from both pre-canister storage container 15 and post-canister storage 17 where the fraction of flow from pre-canister storage container 17 is determined by $f_i$. The amount of inhalation work is therefore increased because the inhalation of gases must be inhaled through the parallel impedences of the canister 13 and the non-linear impedence component 25. In

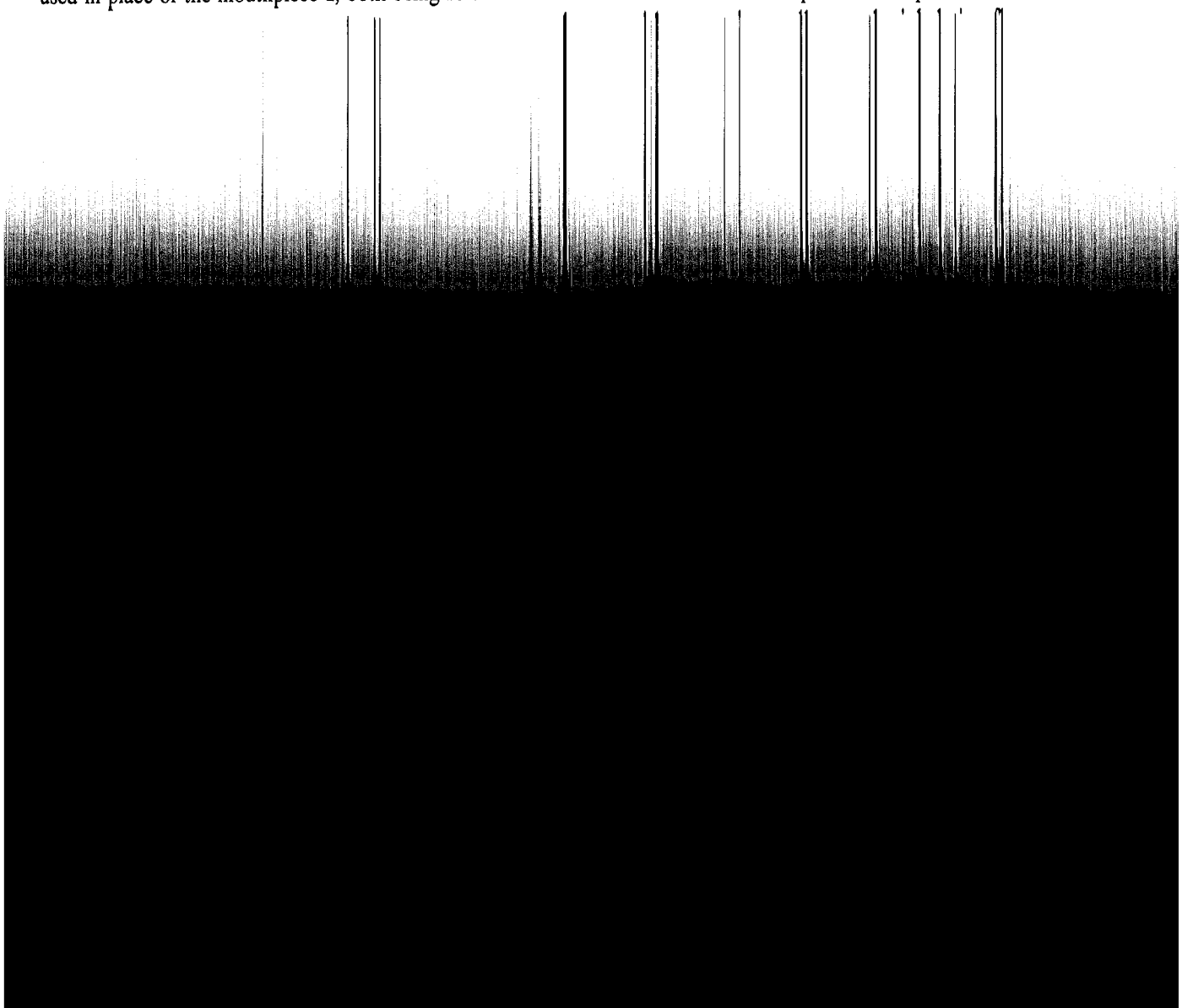

When the balanced breathing system was introduced, the exhalation resistance was reduced to 50 mm of water, and inhalation resistance was 43 mm of water.

It should be appreciated that with small portions of the gas removed at the canister and at the mouthpiece, make-up gases must be added to the breathing circuit. In addition, the apparatus of the present invention may advantageously include a demand regulator, over pressure relief, emergency bypass, and/or other desirable components. These features are well known to those experienced in the art of closed circuit breathing apparatus.

The balanced closed circuit self-contained breathing apparatus of the invention will be of benefit to all wearers of the apparatus and particularly to mine rescue men, firemen and armed forces personnel.

Although only preferred embodiments of the invention have been shown and illustrated herein, it will be understood that various modifications and changes can be made in the construction shown without departing from the spirit of the invention as pointed out in the appendent claims.

It is claimed:

1. A self-contained closed circuit having an inhalation conduit and an exhalation conduit comprising in combination:

a mouthpiece in fluid communication with said conduits;

an inhalation check valve and an exhalation check valve on either side of said mouthpiece providing unidirectional flow through said inhalation and exhalation conduits, respectively;

a chemical canister connected across said inhalation and exhalation conduits;

a post-canister storage container communicating with said inhalation circuit;

a pre-canister storage container communicating with said exhalation conduit, said pre-canister storage container being provided with a unidirectional impedance component comprised of a resistance means for allowing one part of the exhaled air during exhalation to pass into the pre-canister storage container and the remainder to pass through said chemical canister into said post-canister storage container and a unidirectional check valve permitting essentially free flow of air out of said pre-canister storage container during inhalation; and said post-canister storage container being provided with a unidirectional impedance component comprised of a unidirectional check valve permitting essentially free flow of air into said post-canister storage container during exhalation and with a resistance means permitting restricted flow of air from said post-canister storage container during inhalation.

2. An apparatus according to claim 1 wherein the pre-canister storage container and the post-canister storage container are each non-resilient bags.

3. An apparatus according to claim 2 wherein said bags have a total volume of at least the greatest expected tidal volume.

4. An apparatus according to claim 3 wherein the bags have a tidal volume of about 5 liters.

5. An apparatus according to claim 1 wherein each of said resistance means are orifices.

6. An apparatus according to claim 1 wherein the resistance means of the unidirectional impedance provided said pre-canister storage container provides a resistance to gas flow approximating $f_eR$ wherein $f_e$ is a positive coefficient and R is the resistance to gas flow of said chemical canister and the resistance means of the unidirectional provided said post-canister storage container provides a resistance to gas flow approximating $f_i \cdot R$ wherein $f_i$ is a positive coefficient and R is the resistance to gas flow of said chemical canister and the resistance means of the non-linear component provided said post-canister storage container provides a resistance to gas flow.

* * * * *